US007913429B1

(12) United States Patent
Wert

(10) Patent No.: US 7,913,429 B1
(45) Date of Patent: Mar. 29, 2011

(54) ORTHOTIC WEDGE SYSTEM

(75) Inventor: Jeffrey L. Wert, Medina, OH (US)

(73) Assignee: Remington Products Company, Wadsworth, OH (US)

( * ) Notice: Subject to any disclaimer, the term of this patent is extended or adjusted under 35 U.S.C. 154(b) by 850 days.

(21) Appl. No.: 11/901,501

(22) Filed: Sep. 19, 2007

(51) Int. Cl.
*A43B 13/38* (2006.01)
*A43B 3/24* (2006.01)
*A43B 7/14* (2006.01)

(52) U.S. Cl. ..... 36/159; 36/100; 36/44

(58) Field of Classification Search ..... 36/159, 36/100, 44, 43, 15, 155–158
See application file for complete search history.

(56) References Cited

U.S. PATENT DOCUMENTS 1,958,097 A * 5/1934 Shaw ..... 36/144
4,800,657 A 1/1989 Brown ..... 36/44
4,823,420 A * 4/1989 Bartneck ..... 12/142 N
5,036,604 A 8/1991 Rosen ..... 36/88
5,345,701 A * 9/1994 Smith ..... 36/144
5,970,628 A 10/1999 Meschan ..... 36/42
6,098,319 A * 8/2000 Epstein ..... 36/159
6,269,555 B1 8/2001 Brown ..... 36/144
6,408,543 B1 * 6/2002 Erickson ..... 36/100
6,601,320 B1 8/2003 Brown ..... 36/25
6,782,643 B2 8/2004 Brown ..... 36/144
7,120,958 B2 10/2006 Copeskey ..... 12/142
7,124,518 B1 * 10/2006 Brown ..... 36/25 R
7,272,900 B1 * 9/2007 Epstein ..... 36/159

* cited by examiner

*Primary Examiner* — Ted Kavanaugh
(74) *Attorney, Agent, or Firm* — Renner, Kenner, Greive, Bobak, Taylor & Weber

(57) ABSTRACT

A system of constructing a pair of devices to provide lateral or medial corrections of a desired degree includes a right foot orthotic shell (20R) and a left foot orthotic shell (20L). A first angled wedge (40A) is connectable to the right shell (20R) and a second angled wedge (40B) is connectable to the left shell (20L) to provide lateral correction. The second wedge (40B) is connectable to the right shell (20R) and the first wedge (40A) is connectable to the left shell (20L) to provide medial correction. A plurality of pairs of wedges (40) can be provided with each pair providing a different angle of correction.

8 Claims, 7 Drawing Sheets

ORTHOTIC WEDGE SYSTEM

TECHNICAL FIELD

This invention relates to a system of heel wedges which can be attached to a foot orthotic shell to correct orthopedic foot problems. More particularly, the system can be provided in kit form whereby the same wedges can be used to correct lateral or medial arch conditions.

BACKGROUND ART

Orthotic devices are used by podiatrists to correct various foot or arch alignment problems. Such problems may include post tibial tendonitis, plantar faciitis, pes planus, pronation, and supination. These conditions are normally treated with preformed orthotics made of a polymeric material and is sold in a variety of sizes and shapes. The podiatrist attempts to match one of those orthotic devices to the needs of the patient. Such is often difficult, and since mass production can only economically justify a minimum number of configurations, the ideal fit for the patent is often compromised.

As a result, orthotics are available which are custom fit for the patient. However, such are quite expensive and, in addition, throughout the treatment process, the needs of the patient may change requiring the frequent creation of new, expensive, custom fit devices. Such is particularly prevalent for infant or child patients whose condition may not necessarily change but who will outgrow custom made devices.

More recently, wedge-like devices have been developed which can be attached to the bottom of a foot orthotic shell. These wedges can be provided with a variety of angles and the podiatrist selects the appropriate wedge and attaches it to the shell. Then, if the patient's condition changes so as to warrant the use of a wedge having a different angle, the wedge can merely be changed. However, such a system does not account for the fact that some patients will need correction on the arch side of the foot, know as a medial condition, while other patients will need correction on the outside of the foot, known as a lateral correction. The prior art does not provide a system wherein wedges can be used interchangeably to selectively provide both lateral and medial correction.

DISCLOSURE OF THE INVENTION

It is thus an object of one aspect of the present invention to provide a system of orthotic wedges which are interchangeable to provide lateral or medial foot correction.

It is an object of another aspect of the present invention to provide such wedges in a kit form for the timesaving use of the practitioner without the need for expensive modification machinery.

These and other objects of the present invention, as well as the advantages thereof over existing prior art forms, which will become apparent from the description to follow, are accomplished by the improvements hereinafter described and claimed.

In general, a system in accordance with the present invention for constructing a pair of devices to provide first or second orthopedic corrections includes a shell for a right foot, a shell for a left foot, and first and second wedges. The first wedge is connectable to the right foot shell and the second wedge is connectable to the left foot shell to provide the first orthopedic correction. The first wedge is connectable to the left foot shell and the second wedge is connectable to the right foot shell to provide the second orthopedic correction.

In accordance with another aspect of the invention, a kit may be provided for constructing a pair of devices to provide first and second orthopedic corrections of a selected degree. The kit includes at least one pair of shells including a first shell for the right foot and a second shell for the left foot. The kit also includes a plurality of pairs of wedges, each pair providing a different degree of correction. Each pair of wedges includes a first wedge and a second wedge, the first wedge of the selected pair of wedges being connectable to the second shell to provide the first orthopedic correction. The second orthopedic correction is provided in that the first wedge of the selective pair of wedges is connectable to the second shell and the second wedge of the selected pair of wedges is connectable to the first shell.

A method of constructing a pair of devices to provide orthopedic corrections includes the steps of selecting a shell for the right foot, selecting a shell for the left foot, selecting a pair of wedges providing the desired amount of correction, placing one of the wedges on the right shell and the other of the wedges on the left shell if one type of correction is required or placing the other of the wedges on the right shell and the one of the wedges on the left shell if a different type of correction is required.

A preferred exemplary orthotic wedge system according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1A:
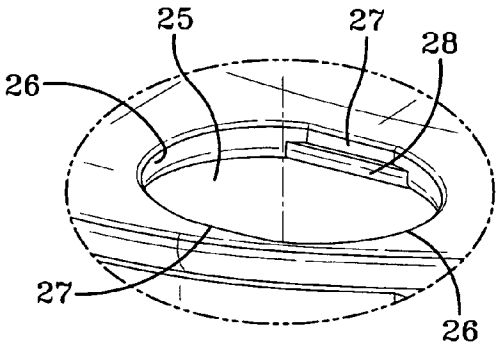
FIG. 1A is an enlarged view of the encircled portion of FIG. 1.
Figure 1B:
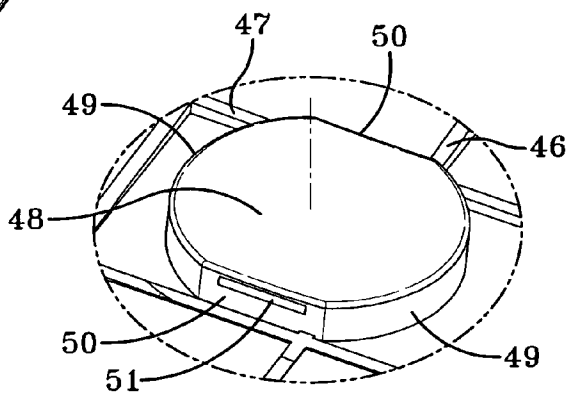
FIG. 1B is an enlarged view of the encircled portion of FIG. 1.

The foundation of the system for creating a pair of orthotic devices includes a foot orthotic shell for the left foot, generally indicated by the numeral 20L, and a foot orthotic shell for the right foot generally indicated by the numeral 20R. Each shell 20, can be made of a suitable plastic material that can be reshaped with heating such as polypropylene, polyvinylchloride, glycol modified polyethylene terephthalete, or like copolymer material, includes a toe portion 21, a central portion 22, and a heel portion generally indicated by the numeral 23. Each central portion 22 includes an arch 24 formed on the inside thereof, that is, on the side adjacent to the other foot.

Each heel portion 23 is shown as having an aperture 25 extending therethrough. As will hereinafter become evident, apertures 25 can generally be of any peripheral configuration other than circular and are shown as being in the form of a racetrack having two opposed curved portions 26 spaced by two opposed straight portions 27. Each straight portion 27 is provided with a lug 28 which extends into the opening of aperture 25.

Figure 11:
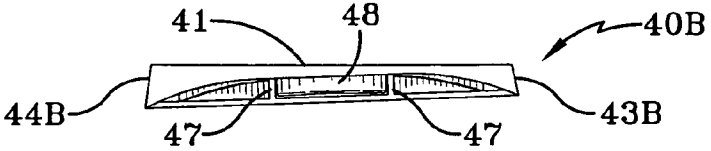
FIG. 11 is a front elevational view of the wedge of FIG. 9.
Figure 10:
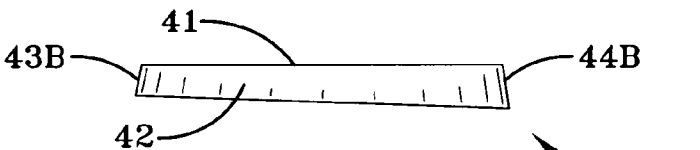
FIG. 10 is a rear elevational view of the wedge of FIG. 9.
Figure 14:
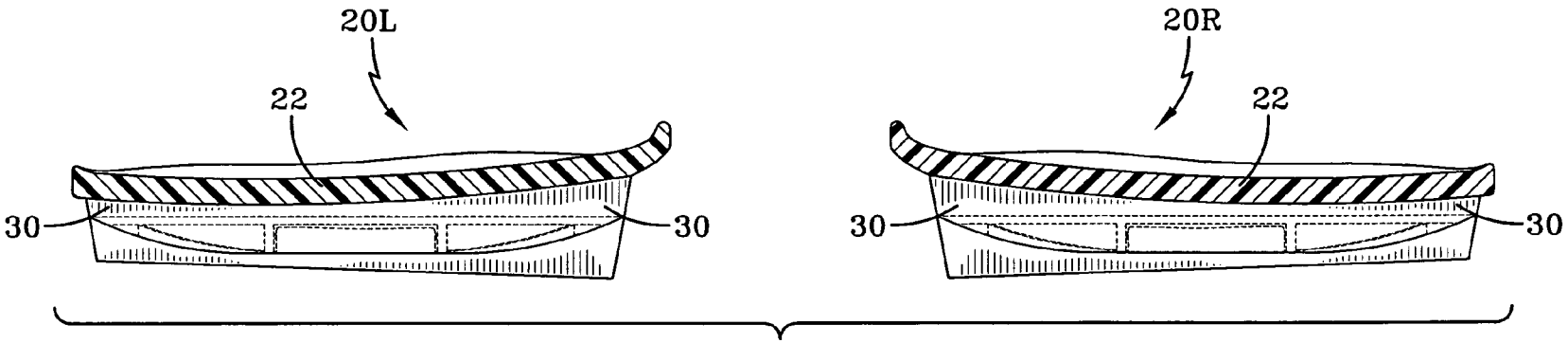
FIG. 14 is a composite sectional view of a pair of shells and wedges taken along line 14-14 of FIG. 1 and showing the wedge of FIG. 6 on the left shell of FIGS. 2 and 3 and the wedge of FIG. 9 on the right shell of FIGS. 4 and 5 to provide medial corrections.
Figure 15:
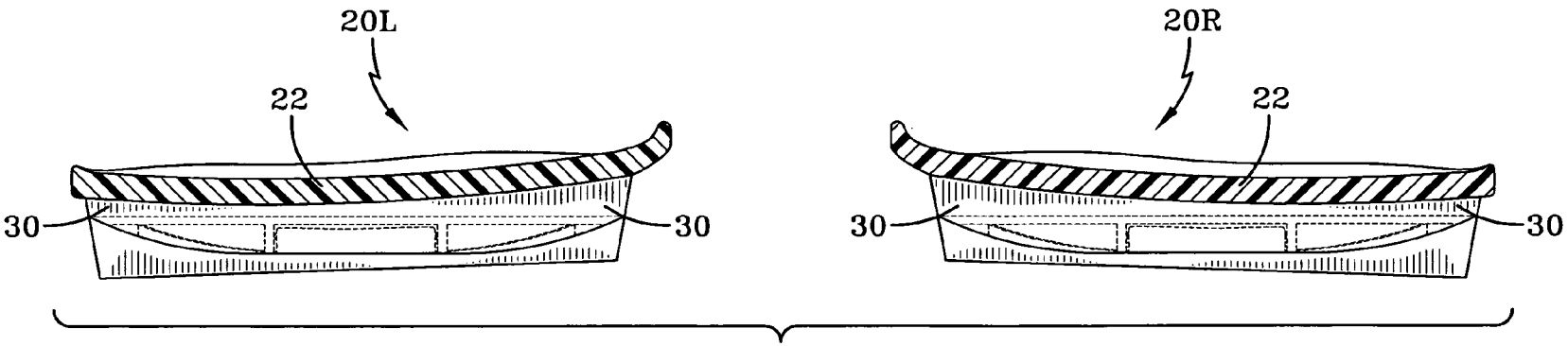
FIG. 15 is a composite sectional view like FIG. 14 but showing the wedge of FIG. 9 on the left shell of FIGS. 2 and 3 and the wedge of FIG. 6 on the right shell of FIGS. 4 and 5 to provide lateral correction.

As best shown in FIGS. 10 and 11, the surface 29 of heel portion 23 is curved to generally conform to the shape of the heel of a foot. The bottom of the surface 29 of each heel portion 23 is provided with ribs 30 which extend laterally from side to side of heel portion 23 and longitudinally extending ribs 31 which intersect ribs 30 to form a ribbing grid. As shown in the drawings, because surface 29 is curved, the height of the ribs 30 and 31 varies. In particular, ribs 31 are of minimal height near aperture 25 and are of their maximum height at the front and rear of heel portion 23. As best shown in FIGS. 14 and 15, ribs 30 are highest on the arch side of shells 20 and lowest on the opposite side.

Figure 9:
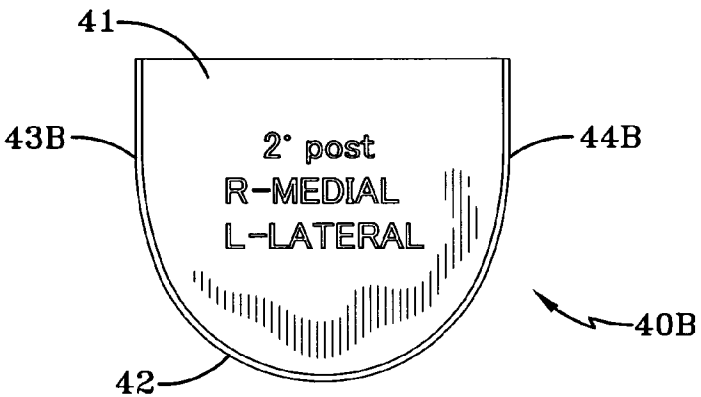
FIG. 9 is a bottom plan view of another wedge made in accordance with the present invention.
Figure 8:
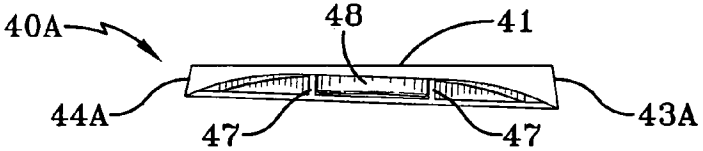
FIG. 8 is a front elevational view of the wedge of FIG. 6.
Figure 6:
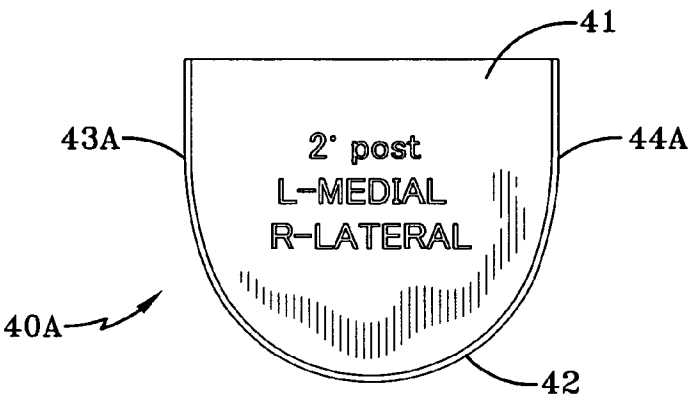
FIG. 6 is a bottom plan view of one wedge made in accordance with the present invention.
Figure 7:
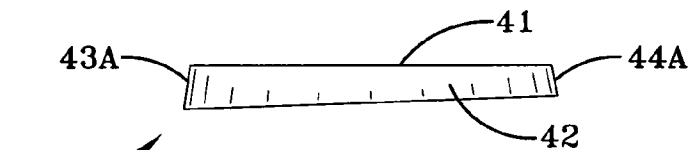
FIG. 7 is a rear elevational view of the wedge of FIG. 6.

Lateral and medial correcting wedges are generally indicated by the numeral 40 with the wedge of FIGS. 6-8 being indicated as wedge 40A and the wedge of FIGS. 9-11 being indicated as wedge 40B. Wedges 40 may also be made of a polypropylene, polyvinylchloride, glycol modified polyethylene terephthalete, or like copolymer material and take the peripheral shape of the heel portions 23 of shells 20L and 20R. Wedges 40 have a flat bottom surface 41 with a generally U-shaped peripheral sidewall having a base 42 and opposed arms 43, 44 extending upwardly from bottom surface 41. A front wall 45 intersects the ends of arms 43, 44. The arm 43, 44 on one side of front wall 43 is higher than the arm 43, 44 on the other side of front wall 43 with the wedges 40A and 40B being mirror images of each other. That is, as shown in FIGS. 6-11, wedge 40A has a sidewall arm 43A that is higher than its opposed sidewall arm 44A, and wedge 40B has a sidewall arm 43B which is lower than its opposed sidewall arm 44B.

Figure 1:
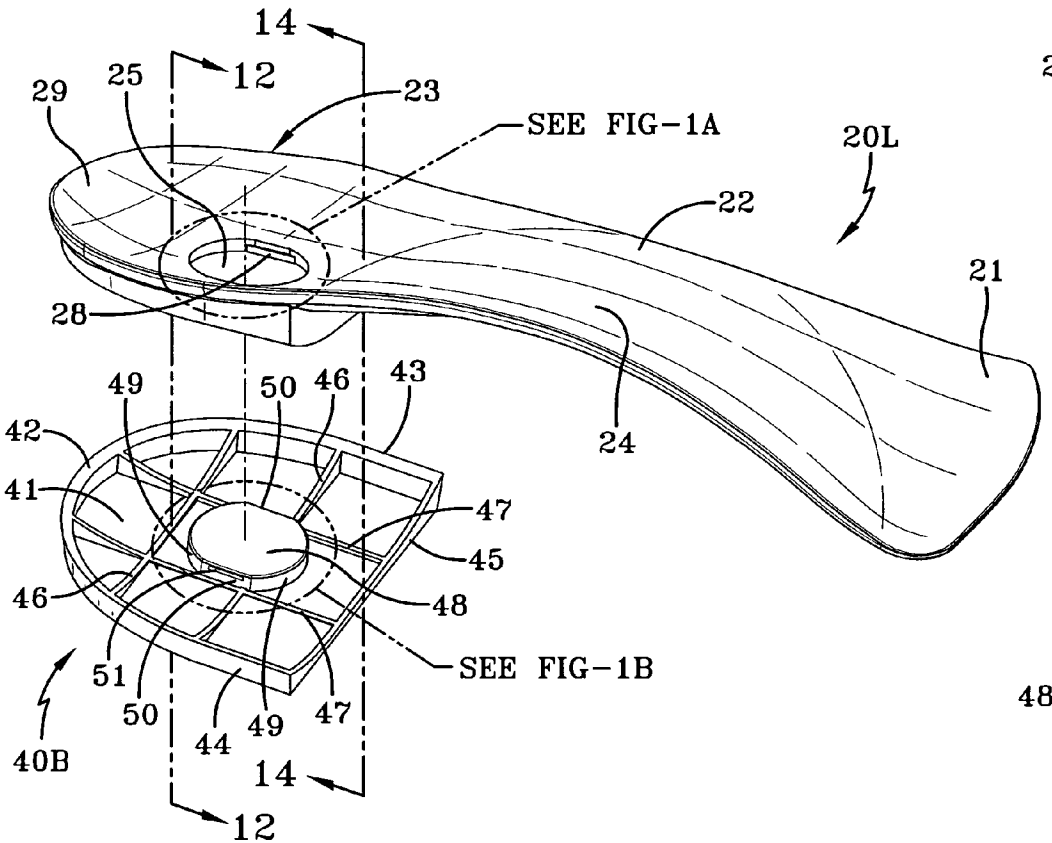
FIG. 1 is an exploded perspective view of a foot orthotic shell and a wedge made in accordance with the concepts of the present invention.
Figure 3:
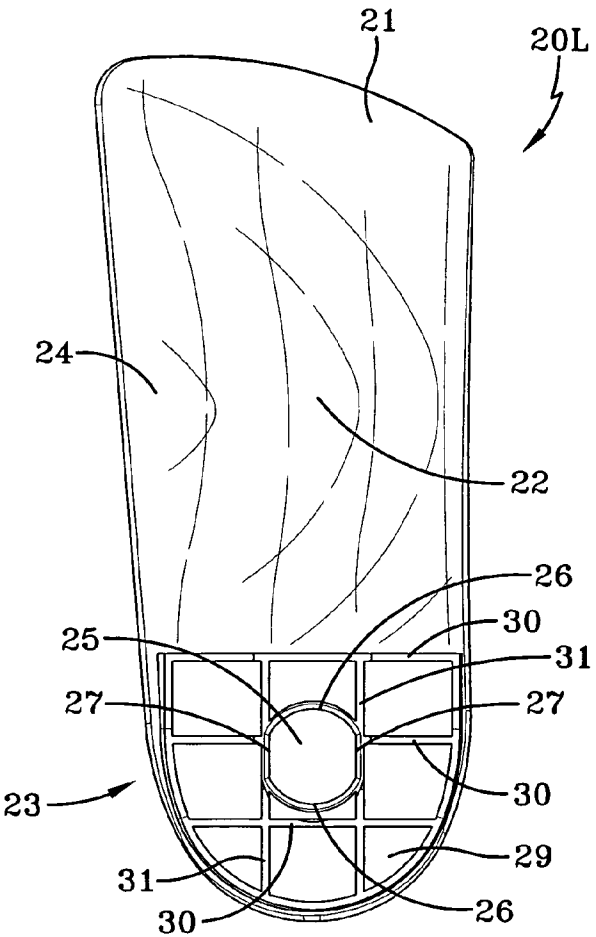
FIG. 3 is a bottom plan view of a shell for the left foot.
Figure 2:
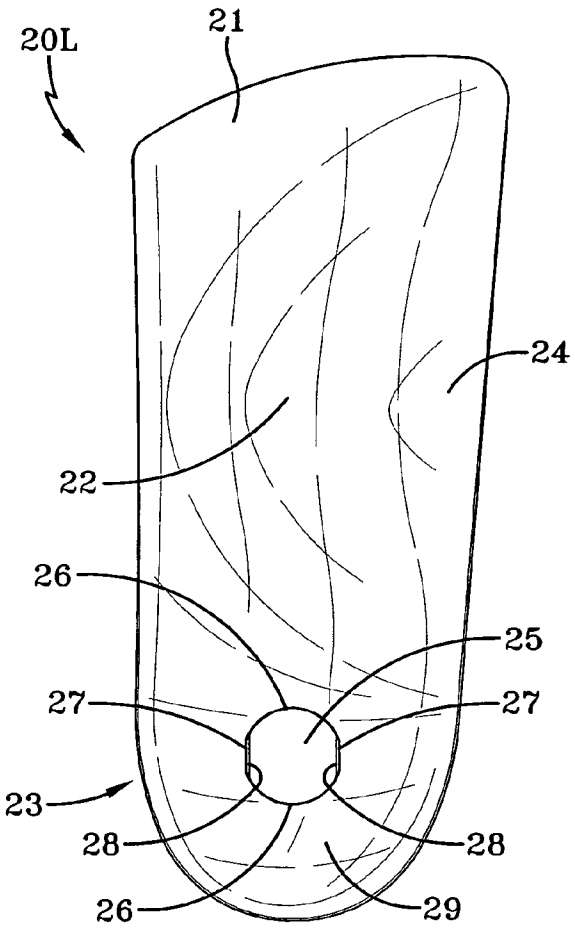
FIG. 2 is a top plan view of the shell for the left foot.
Figure 5:
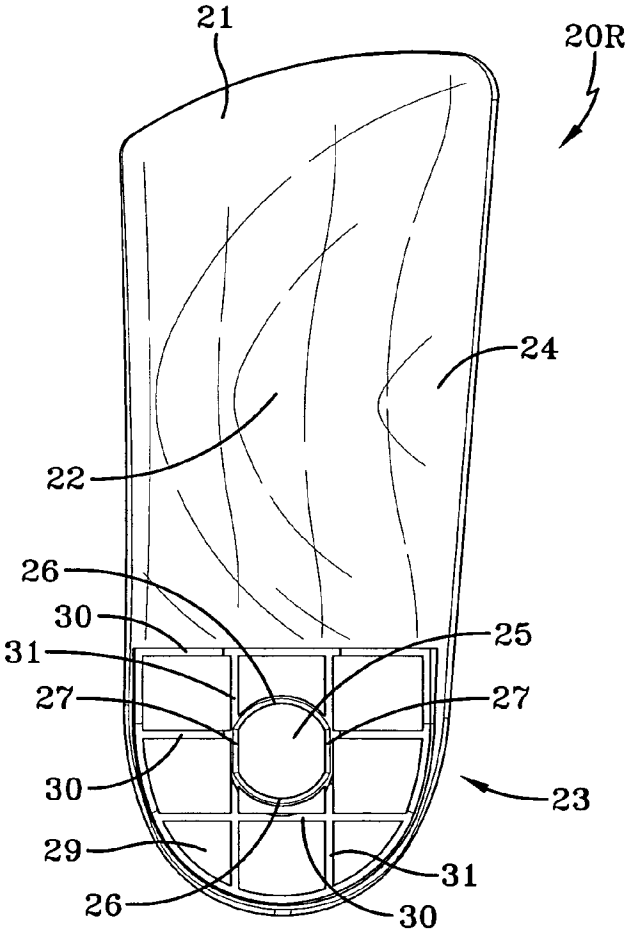
FIG. 5 is a bottom plan view of a shell for the right foot.
Figure 4:
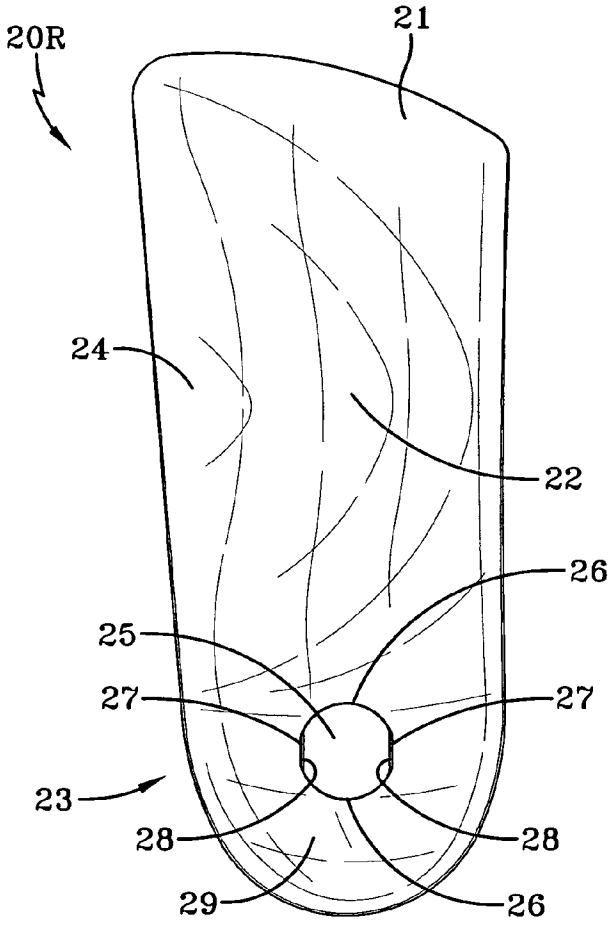
FIG. 4 is a top plan view of a shell for the right foot.

A pattern of ribbing extends upwardly from bottom surface 41 of each wedge 40 and generally matches the ribbing grid of heel portions 23 of shells 20. Thus, ribs 46 extend laterally from side to side of wedges 40 and longitudinally extending ribs 47 intersect ribs 46. Ribs 46, 47 generally parallel the curvature of surface 29 of heel portion 23 of shells 20 and thus, as shown in FIG. 1, ribs 46 are shallowest at their centers and extend outwardly higher until they reach arms 43, 44. Ribs 47 are shallowest at the front wall 45 of wedges 40 and extend higher as they reach sidewall base 42.

Each wedge 40 also includes a hub 48 extending upwardly from bottom surface 41 generally centrally thereof and between longitudinal ribs 47. Hub 48 can generally have any peripheral shape other than circular and its shape should match that of shell aperture 25. Thus, hub 48 is shown as being in the form of a racetrack having two opposed curved surfaces 49 spaced by opposed straight portions 50. Each straight portion 50 is provided with a lug 51 which extends outwardly therefrom.

As will hereinafter be described in more detail, a selected wedge 40 is attached to a selected shell 20 by merely positioning hub 48 into aperture 25 and pushing hub 48 inwardly until lug 51 snaps over lug 28 to attach wedge 40 to shell 20. Such an attachment is shown in FIGS. 12-15. To remove a wedge 40 from a shell 20, one need only push downwardly on hub 42, which is exposed on the top of shell 20, to move lug 51 past lug 28.

For the convenience of the podiatrist, the shell 20/wedge 40 combinations can be provided in kit form with left and right shells 20L, 20R of one or more sizes, and a plurality of wedges 40 being provided in each kit. These wedges 40 are provided in pairs 40A and 40B, each pair having a different posting angle, that is, the angle provided by the difference in heights between sidewall arms 43 and 44 of wedges 40. Thus, for example, four pairs of wedges 40 might be provided in each kit possibly having, but not limited to, posting angles of 0°, 2°, 4°, and 6°. Wedges 40A and 40B are shown in FIGS. 6 and 10 as being marked as a pair of wedges having a 2° posting angle. By providing a plurality of angle selections, the podiatrist is able to select the pair of wedges 40 having the angle currently needed by the patient, and attach those wedges 40 to the shells 20. At a later date, if the patient needs to have his correction changed, a pair of wedges 40 having a different angle can conveniently be substituted for the wedges 40 currently attached to the shells 20.

Figure 12:
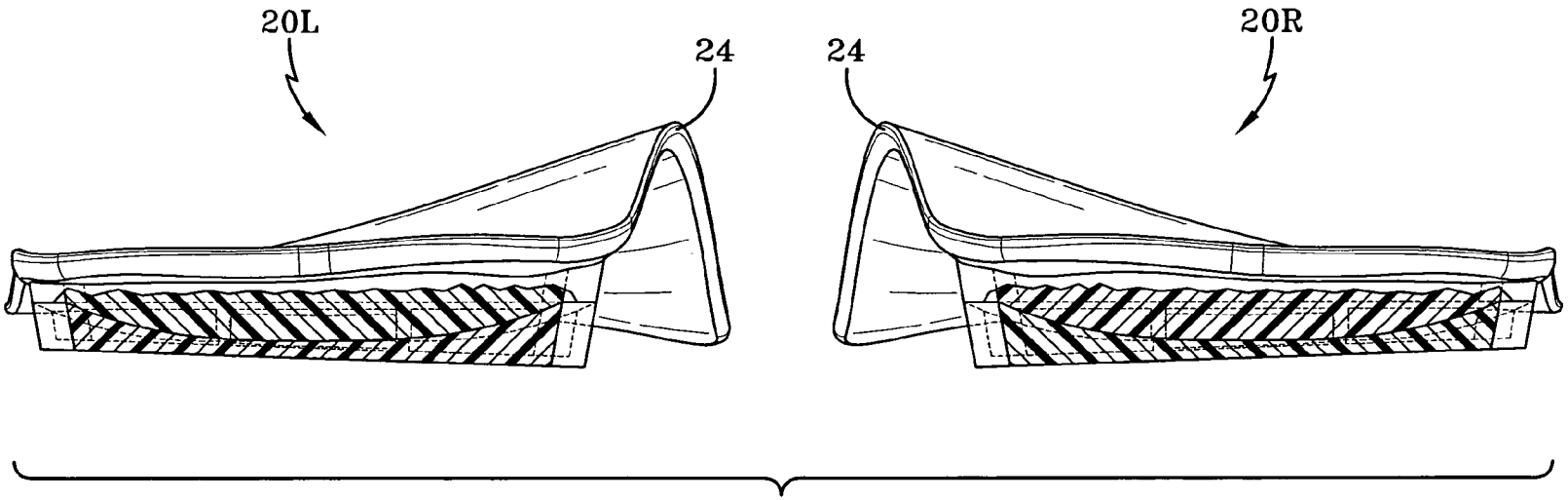
FIG. 12 is a composite sectional view of a pair of shells and wedges taken generally along line 12-12 of FIG. 1 and showing the wedge of FIG. 6 on the left shell of FIGS. 2 and 3 and the wedge of FIG. 9 on the right shell of FIGS. 4 and 5 to provide medial corrections.
Figure 13:
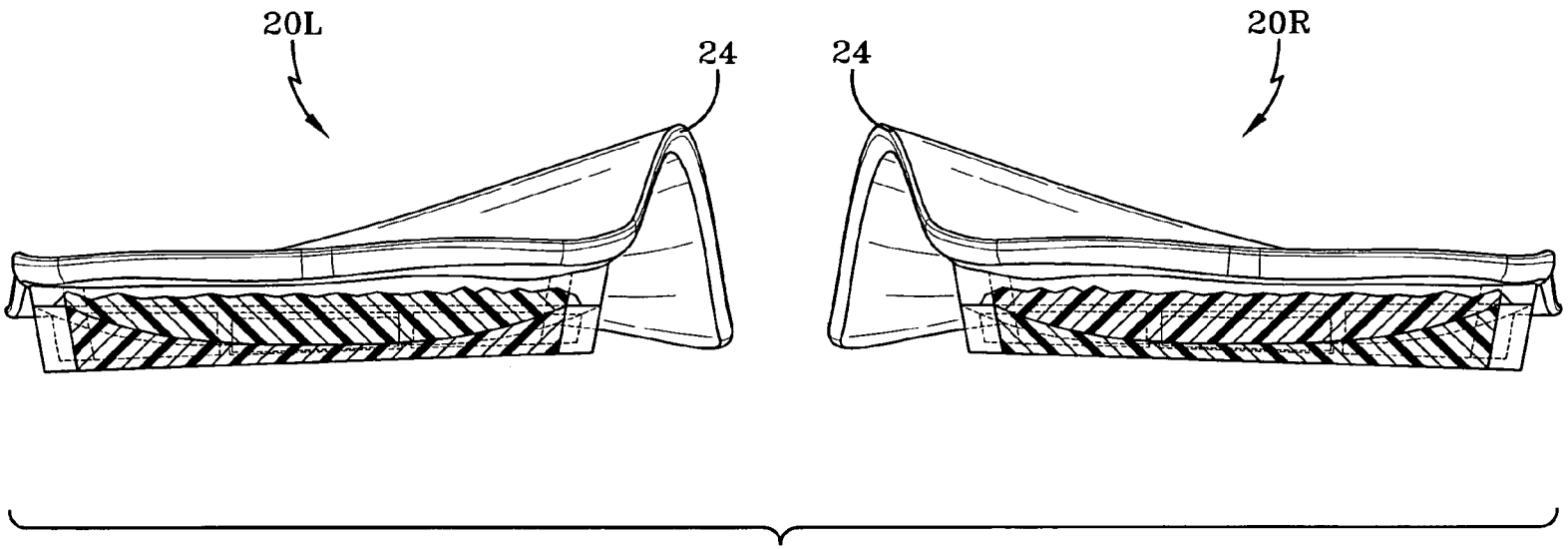
FIG. 13 is a composite sectional view like FIG. 12 but showing the wedge of FIG. 9 on the left shell of FIGS. 2 and 3 and the wedge of FIG. 6 on the right shell of FIGS. 4 and 5 to provide lateral corrections.

Of importance is that because of the configuration of wedges 40 and shells 20, just described, each pair of wedges 40 can be interchangeably used for both medial and lateral correction. For example, if medical corrections are required, wedge 40A of FIG. 6 is put onto left shell 20L and wedge 40B of FIG. 9 is put onto right shell 20R. Such an assembly is shown in FIGS. 12 and 14 wherein it can be seen that the inside arch sides of the shells 20 are higher than the outside of the shells 20. However, if lateral corrections are required, the wedges 20 of the desired pair merely need to be reversed. That is, wedge 40A of FIG. 6 is put onto right shell 20R and wedge 40B of FIG. 9 is put onto left shell 20L resulting in corrections shown in FIGS. 13 and 15, that is, the inside, arch sides of shells 20 are lower than the outside of each shell 20. The indicia "L-MEDIAL R-LATERAL" imprinted on wedge 40A and "R-MEDIAL L-LATERAL" imprinted on wedge 40B instructs the user as to the correct assemblage of the orthotic devices dependent on the desired result.

In view of the forgoing, it should be apparent that orthotic devices construction as described herein accomplish the objects of the present invention and otherwise substantially improve the art.

What is claimed is:

1. A system of constructing a pair of devices to provide first or second orthopedic corrections comprising a shell for a right foot, a shell for a left foot, a first wedge, and a second wedge, each said shell having an aperture having lugs and opposed curved portions spaced by opposed straight portions, each said wedge having lugs and a hub having opposed curved portions spaced by opposed straight portions, said lugs of said hubs snapping over said lugs of said apertures as said hubs are inserted into said apertures, said first wedge being connectable to said right foot shell and said second wedge being connectable to said left foot shell to provide the first orthopedic correction, and said first wedge being connectable to said left foot shell and said second wedge being connectable to said right foot shell to provide the second orthopedic correction.

2. The system of claim 1 wherein said lugs are on said straight portions.

3. The system of claim 1 wherein each said wedge includes a bottom surface and opposed first and second arms extending upwardly from said bottom surface, said first arm of said first wedge being longer than said second arm of said first wedge, and said first arm of said second wedge being shorter than said second arm of said second wedge, such that when said wedges are attached to said shells, an angle of inclination is created for each shell.

4. The system of claim 3 further comprising a plurality of additional pairs of first and second wedges, said additional pairs each providing a different angle of inclination for said shells.

5. A kit for constructing a pair of devices to provide first or second orthopedic corrections of a selected degree comprising at least one pair of shells including a first shell for the right foot and a second shell for the left foot; and a plurality of pairs of wedges, said pairs of wedges providing different degrees of correction; each said pair of wedges includes a first wedge and a second wedge; each said shell having an aperture having lugs and opposed curved portions spaced by opposed straight portions, each said wedge having lugs and a hub having opposed curved portions spaced by opposed straight portions, said lugs of said hubs snapping over said lugs of said apertures as said hubs are inserted into said apertures, said first wedge of a selected pair of wedges being connectable to said first shell and said second wedge of said selected pair of wedges being connectable to said second shell to provide the first orthopedic correction; said first wedge of said selected pair of wedges being connectable to said second shell and said second wedge of said selected pair of wedges being connectable to said first shell to provide the second orthopedic correction.

6. The kit of claim 5 wherein said lugs are on said straight portions.

7. The kit of claim 5 wherein each said wedge includes a bottom surface and opposed first and second arms extending upwardly from said bottom surface, said first arm of said first wedge being longer than said second arm of said first wedge, and said first arm of said second wedge being shorter than said second arm of said second wedge, such that when said wedges are attached to said shells, an angle of inclination is created for each shell.

8. The kit of claim 7 wherein the angle of inclination varies between said plurality of pairs of wedges.

* * * * *